US011565532B2

(12) United States Patent
Yoshii

(10) Patent No.: US 11,565,532 B2
(45) Date of Patent: Jan. 31, 2023

(54) PRINTING APPARATUS, PRINTING CONTROL METHOD, AND NONTRANSITORY COMPUTER-READABLE RECORDING MEDIUM

(71) Applicant: CASIO COMPUTER CO., LTD., Tokyo (JP)

(72) Inventor: Masakazu Yoshii, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 17/366,571

(22) Filed: Jul. 2, 2021

(65) Prior Publication Data

US 2022/0055373 A1 Feb. 24, 2022

(30) Foreign Application Priority Data

Aug. 21, 2020 (JP) ..... JP2020-140180
Mar. 15, 2021 (JP) ..... JP2021-041209

(51) Int. Cl.
*B41J 2/21* (2006.01)
*B41J 2/045* (2006.01)

(52) U.S. Cl.
CPC ..... *B41J 2/2135* (2013.01); *B41J 2/04505* (2013.01); *B41J 2/04586* (2013.01)

(58) Field of Classification Search
CPC .. B41J 2/04505; B41J 2/04508; B41J 2/0456; B41J 2/04586; B41J 2/2135; B41J 2/12
See application file for complete search history.

(56) References Cited

U.S. PATENT DOCUMENTS 8,233,159 B2 * 7/2012 Ohmiya ..... G03G 15/0194 400/279
8,807,686 B2 8/2014 Murai
10,093,087 B2 * 10/2018 Kawarada ..... B41J 2/04586
2008/0139072 A1 6/2008 Kinoshita
(Continued)

FOREIGN PATENT DOCUMENTS

JP 2000094655 A 4/2000
JP 2008142654 A 6/2008
(Continued)

OTHER PUBLICATIONS

Japanese Office Action (and English language translation thereof) dated Aug. 16, 2022, issued in counterpart Japanese Application No. 2021-041209.
(Continued)

*Primary Examiner* — Thinh H Nguyen
(74) *Attorney, Agent, or Firm* — Holtz, Holtz & Volek PC

(57) ABSTRACT

A printing apparatus includes: a plurality of heads configured to print mutually different colors; and a control unit configured to control the heads. The control unit operates the first head, configured to print a first color distinguishable from a surface color of an adjustment paper, to print a first correction pattern for performing alignment correction of the first head on the adjustment paper, and operates the second head, configured to print a second color distinguishable from the first color, to print a second correction pattern for performing alignment correction of the second head on the adjustment paper so as to at least partially overlap a first color area that is an area formed by the first head.

19 Claims, 11 Drawing Sheets

(56) References Cited

U.S. PATENT DOCUMENTS

| | | | |
|---|---|---|---|
| 2013/0036972 | A1 | 2/2013 | Kinoshita |
| 2018/0361736 | A1 | 12/2018 | Irie |

FOREIGN PATENT DOCUMENTS

| | | | |
|---|---|---|---|
| JP | 2011126197 | A | 6/2011 |
| JP | 2017018589 | A | 1/2017 |

OTHER PUBLICATIONS

Chinese Office Action (and English language translation thereof) dated Nov. 3, 2022, issued in counterpart Chinese Application No. 202110841248.0.

* cited by examiner

PRINTING APPARATUS, PRINTING CONTROL METHOD, AND NONTRANSITORY COMPUTER-READABLE RECORDING MEDIUM

CROSS-REFERENCE TO RELATED APPLICATIONS

This application claims the priority to and benefit of Japanese Patent Application No. 2020-140180 filed on Aug. 21, 2020 and Japanese Patent Application No. 2021-041209 filed on Mar. 15, 2021. The entire specification, claims, and drawings of Japanese Patent Application No, 2020-140180 and Japanese Patent Application No. 2021-041209 are incorporated herein by reference.

BACKGROUND

1. Technical Field

The present disclosure relates to a printing apparatus, a printing control method, and a non-transitory computer-readable recording medium.

2. Related Art

Conventionally, printing apparatuses (nail printing apparatuses) that print nail designs on nails of fingers or the like have been known.

If such printing apparatuses are used, it is possible to easily enjoy nail printing.

When nail printing is performed by a printing apparatus, it is necessary to accurately perform the printing at a predetermined position of a nail. In this regard, a print head that performs printing is used by being mounted on a carriage of an apparatus body, but there is a possibility that mounting a position deviation and looseness occur at the time of attaching and replacing the print head since the carriage and the print head have mounting play due to tolerance or the like at a manufacturing stage.

When printing is performed with the positional deviation or the like occurring in the print head, there is a possibility that a design printed on a nail deviates or is printed to protrude to a skin portion other than the nail.

Therefore, for example, JP 2017-18589 A discloses a technique in which a correction pattern (a position adjustment mark in JP 2017-18589 A) on a print target surface (a surface of a nail in JP 2017-18589 A) in a color tone lower than a color tone of an ink used for printing a nail design and a print position by a print head is adjusted based on an image of the print target surface to which the correction pattern has been output.

SUMMARY

In order to solve the above problems, a printing apparatus of the present invention includes: a plurality of heads including at least a first head and a second head for alignment correction configured to print mutually different colors on a print target surface; and at least one processor configured to control the heads, in which the processor is configured to: operate the first head, configured to print a first color distinguishable from a surface color of the print target surface, to print a first correction pattern on the print target surface; and operate the second head, configured to print a second color distinguishable from the first color, to print a second correction pattern on the print target surface so as to at least partially overlap a first color area which is an area formed by printing of the first head.

DETAILED DESCRIPTION

An embodiment of a printing apparatus, a printing control method, and a program according to the present invention will be described with reference to FIGS. 1 to 8C.

Although various technically preferable limitations are given to the embodiment described later in order to carry out the present invention, a scope of the present invention is not limited to the following embodiment and illustrated examples.

The printing apparatus of the present embodiment performs printing on a print target surface. Specifically, for example, a nail of a finger of a hand is set as the print target surface, and nail printing is performed using a surface of the nail as the print target surface. In addition, when alignment of a print head, which will be described later, is performed, the printing apparatus uses predetermined paper (adjustment paper P to be described later) on which a correction pattern for performing alignment correction is printed, as a print target s performed, and prints a correction pattern on a surface (print target surface) of the paper.

Note that the printing apparatus according to the present disclosure may use an object other than those illustrated herein as the print target, and a nail of a toe, for example, may be used as the print target. In addition, a nail-like object other than a human nail, such as surfaces of nail tips or various accessories, various sheets, seals, and the like may be used as the print target.

Figure 1:
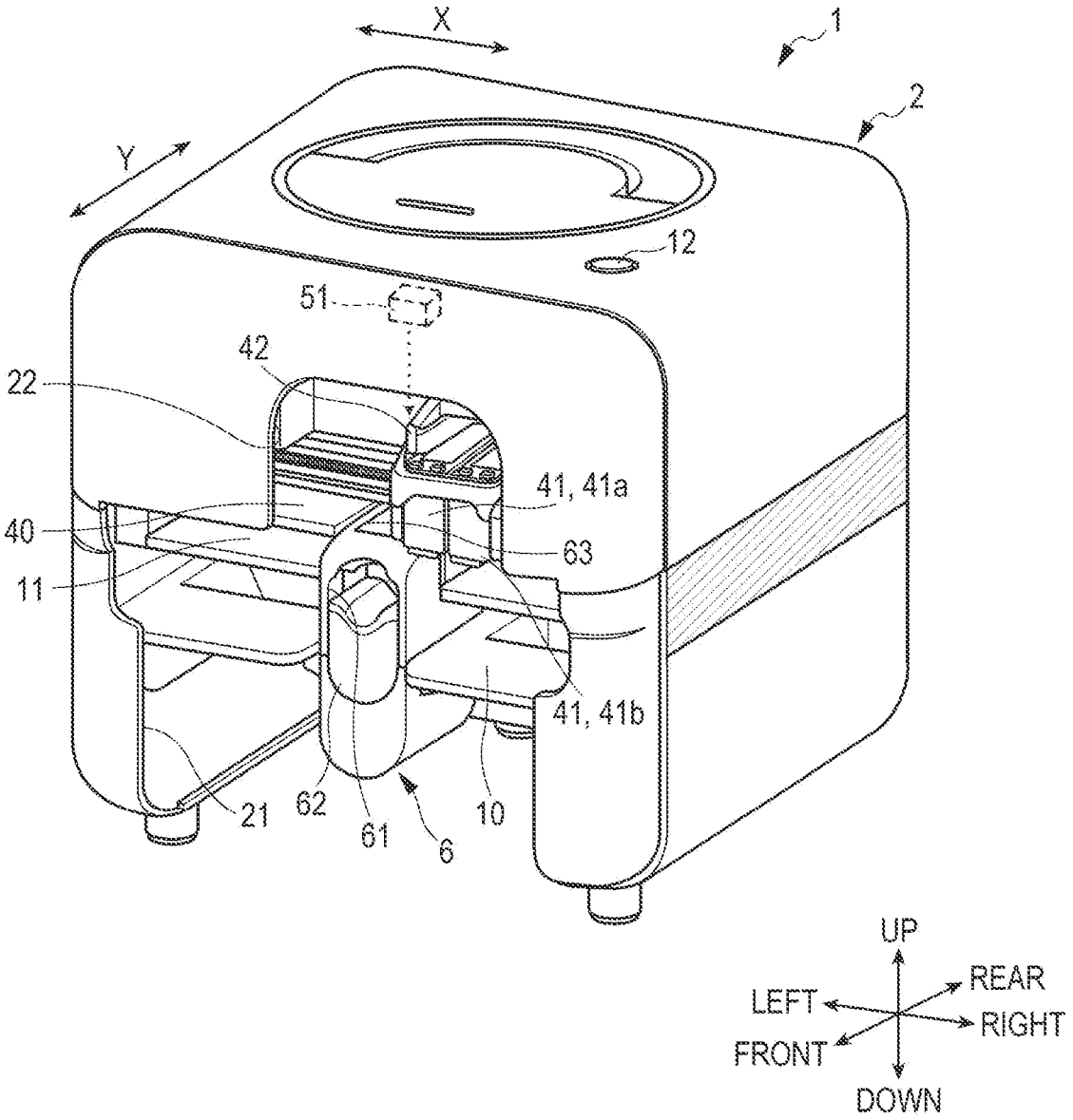
FIG. 1 is a view illustrating a schematic configuration of a printing apparatus in the present embodiment.
Figure 2:
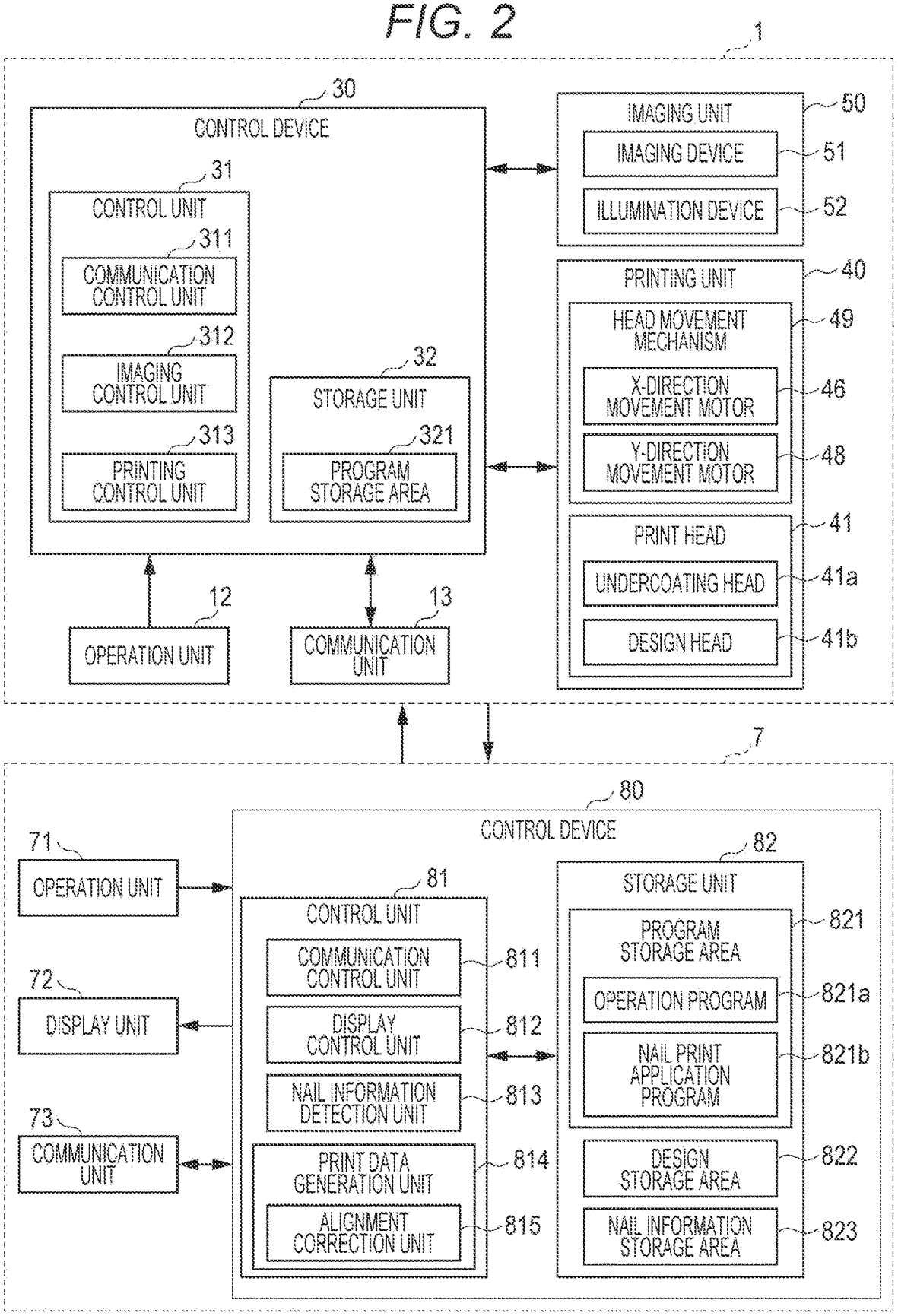
FIG. 2 is a block diagram of main parts illustrating a control configuration of the printing apparatus and a terminal device cooperating with the printing apparatus in the present embodiment.

FIG. 1 is a perspective view illustrating an external configuration of main parts of the printing apparatus according to the present invention. FIG. 2 is a block diagram illustrating a control configuration of the main parts of the printing apparatus according to the present embodiment.

In the following embodiment, up and down, left and right, and front and back refer to directions illustrated in FIG. 1. In addition, an X direction and a Y direction refer to directions illustrated in FIG. 1.

As illustrated in FIG. 2, a printing apparatus 1 of the present embodiment is configured to be capable of communicating with an external terminal device (terminal device 7 in FIG. 2) to cooperate with each other.

As illustrated in FIG. 1, the printing apparatus 1 has a housing 2 formed in a substantially box shape.

The housing 2 has an opening 21 formed over substantially the entire surface in the left-right direction (the lateral direction of the printing apparatus 1, the left-right direction in FIG. 1, and the X direction) in a lower portion on the front surface side (the front side of the printing apparatus 1 and the front side in FIG. 1). In addition, a notch 22 is continuously formed on the upper side of the opening 21 substantially at the center of the housing 2 in the left-right direction. The notch 22 functions as an entrance when a print head 41, which will be described later, is attached to and detached from the apparatus.

An operation unit 12 of the printing apparatus 1 is provided on an upper surface (top plate) of the housing 2. The operation unit 12 is, for example, an operation button (power switch button) configured to turn on/off the power of the printing apparatus 1. When the operation unit 12 is operated, an operation signal is output to a control device 30, and the control device 30 performs control according to the operation signal to operate each unit of the printing apparatus 1. For example, in a case where the operation unit 12 is a power switch button, the power of the printing apparatus 1 is turned on/off according to the button operation.

Note that each unit of the printing apparatus 1 may operate according to an operation signal input from an operation unit 71 of a terminal device 7, which will be described later, instead of the operation unit 12.

An external configuration of the printing apparatus 1, a shape of each portion of the housing 2, an arrangement of each portion, and the like are not limited to the illustrated example, and can be appropriately set. For example, the operation unit 12 may be provided on a side surface, a back surface, or the like of the housing 2, instead of the upper surface. In addition, the housing 2 may be provided with other various operation buttons as the operation unit 12, or may be provided with various display units, indicators, and the like.

An apparatus body 10 is accommodated in the housing 2.

The apparatus body 10 includes a base 11, a finger holder 6 attached thereto, a printing unit 40, and the like.

The finger holder 6 is arranged substantially at the center of the base 11 in the left-right direction (X direction) on the apparatus front surface side, and is a finger holding unit configured to hold a finger (not illustrated) having a nail, which is the print target in the present embodiment, at a position suitable for printing.

Figure 3:
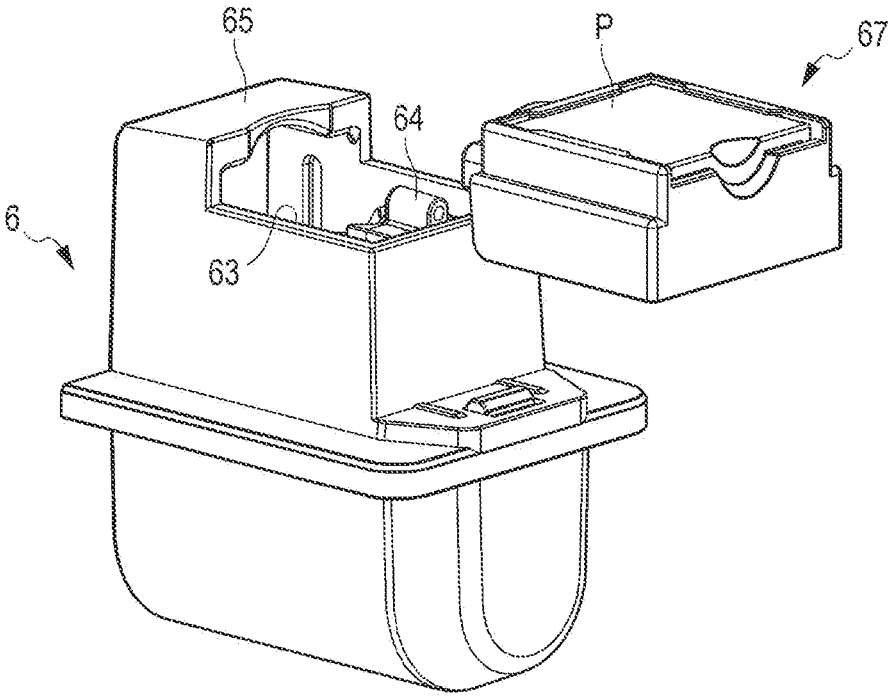
FIG. 3 is a perspective view illustrating a state where a paper arrangement member is to be mounted on a body of a finger holder.

FIG. 3 is a perspective view of the finger holder of the present embodiment as viewed obliquely from the rear.

As illustrated in FIGS. 1 and 3, the finger holder 6 has an opening 61 on the apparatus front surface side. In addition, a finger fixing member 62 is provided inside the finger holder 6. The finger fixing member 62 pushes up and supports the finger inserted through the opening 61 from below, and is made of, for example, a flexible resin or the like.

On an upper surface on the back side (apparatus rear side) of the finger holder 6, a window portion 63 is formed to expose a nail portion of a finger inserted from the opening 61 and held by the finger fixing member 62.

As illustrated in FIG. 3, a nail placement portion 64 on which a distal portion of the nail is placed is provided inside the finger holder 6. An upper surface of the finger holder 6 closer to the front side (apparatus front side) than the window portion 63 serves as a finger presser 65 that regulates an upper surface position of the finger.

The finger inserted into the finger holder 6 is held in the state of being arranged at an appropriate position suitable for printing by the print head 41 as a nail tip is placed on the nail placement portion 64 and the upper surface of the finger is regulated by the finger presser 65.

As illustrated in FIG. 3, the finger holder 6 of the present embodiment is detachably provided with a paper arrangement member 67 that arranges adjustment paper P at a predetermined position in a case where the adjustment paper P is used as a print target.

As will be described later, the adjustment paper P is paper on which a correction pattern for alignment correction is printed, and is white paper having a paper quality suitable for various types of printing, or paper having a color (for example, black) in which an ink of white or a color close thereto is conspicuous and a paper quality suitable for various types of printing.

The printing apparatus 1 may include the adjustment paper P of any color (surface color) in advance, or paper appropriately prepared by a user may be set as the adjustment paper P in the paper arrangement member 67.

FIG. 3 illustrates a state where the paper arrangement member 67 is to be mounted on a body of the finger holder 6. When the paper arrangement member 67 is attached to the finger holder 6, the paper arrangement member 67 is mounted so as to cover the window portion 63 from the rear of the finger holder 6 as illustrated in FIG. 3.

As the paper arrangement member 67 in a state where the adjustment paper P has been set is attached to the finger holder 6, a surface of the adjustment paper P (that is, a print target surface when the adjustment paper P is the print target) is arranged at a height position that is substantially flush with a height position of a surface of the nail (that is, a print target surface when the nail is the print target) of the nail at the time of being arranged at an appropriate position suitable for printing.

The printing unit 40 is a printing unit configured to perform printing on a surface of a nail T, which is a print target surface, in accordance with data for printing generated by a print data generation unit 814 to be described later (a control unit 81 of the terminal device 7 to be described later, see FIG. 2).

The printing unit 40 includes a head (hereinafter, referred to as the "print head 41") configured to perform a printing operation, a carriage 42 on which the print head 41 is mounted and held, and a head movement mechanism 49 (see FIG. 2) configured to move the print head 41 and the carriage 42, and the like.

As illustrated in FIG. 1, the print head 41 is mounted on the carriage 42.

The printing apparatus 1 includes a plurality of heads that print mutually different colors on the print target surface (the surface of the nail or the surface of the adjustment paper P), and an undercoating head 41*a* and a design head 41*b* are installed as the print head 41 in the present embodiment. Hereinafter, both the undercoating head 41*a* and the design head 41*b* are included in the case of being simply referred to as the "print head 41". Note that arrangements and the like of the undercoating head 41*a* and the design head 41*b* are not limited to the illustrated example.

In the present embodiment, a correction pattern M (see FIGS. 6B and 7A, and the like) for performing alignment correction is printed using the print head 41 (the undercoating head 41*a* and the design head 41*b*).

Note that the correction pattern M to be printed by the print head 41 will be described in detail later.

The undercoating head 41*a* is a head configured to print a part other than a design, and prints a liquid agent (hereinafter, referred to as an "undercoating ink") which forms an undercoating in an area where the design is to be printed before printing the design. The undercoating ink printed by the undercoating head 41*a* is preferably a liquid agent having a white color or a color close thereto such that color development of an ink is improved at the time of printing the design. As the undercoating is thrilled with white or the like, it is easy to distinguish from a color of a skin (skin color or the like) around the nail T, and an area of the nail T can be more accurately recognized from a nail image.

The design head 41*b* prints the design on an area where the undercoating has been printed after the undercoating printing performed by the undercoating head 41*a*, and can eject inks of the respective colors, for example, cyan (C: cyan), magenta (M: magenta), yellow (Y: yellow) and the like (hereinafter, referred to as "color inks"). Note that a type of a color ink that can be ejected by the design head 41*b* is not limited thereto, and inks of other colors may be ejected.

In the present embodiment, a surface facing the nail surface is an ink ejection surface (not illustrated) having a plurality of nozzle ports for ejecting inks in both the undercoating head 41*a* and the design head 41*b*, and is an ink jet head in an ink jet system that performs printing by atomizing an ink and directly spraying the ink from the ink ejection surface to the nail surface that is the print target surface of the print target (nail T).

The head movement mechanism 49 includes an X-direction movement mechanism (not illustrated) configured to move the print head 41 in the left-right direction (X direction) of the apparatus and a Y-direction movement mechanism (not illustrated) configured to move the print head 41 in the front-hack direction (Y direction) of the apparatus.

The X-direction movement mechanism includes an X-direction movement motor 46, and drives the X-direction movement motor 46 to move the print head 41 in the left-right direction (X-direction) of the apparatus. In addition, the Y-direction movement mechanism includes a Y-direction movement motor 48, and drives the direction movement motor 48 to move the print head 41 in the front-back direction (Y-direction) of the apparatus.

Operations of the X-direction movement motor 46, the Y-direction movement motor 48, and the print head 41 (an ejection mechanism of the print head 41) of the head movement mechanism 49 are controlled by a printing control unit 313 (see FIG. 2) of the control device 30.

In addition, an imaging unit 50, configured to image the nail (finger including the nail) exposed from the window portion 63 or the surface (print target surface) of the adjustment paper P set on the paper arrangement member 67 and acquire an image of the nail (an image of the finger including the nail, hereinafter referred to as a "nail image") and a paper image of the adjustment paper P is provided inside the upper surface (top plate) of the housing 2 at a position above the window portion 63 of the finger holder 6.

The imaging unit 50 includes an imaging device 51, for example, a camera or the like, and an illumination device 52 configured using a white LED or the like that illuminates the nail or the adjustment paper P to be imaged (see FIG. 2).

The imaging unit 50 is connected to an imaging control unit 312 (see FIG. 2) of the control device 30 to be described later, and is controlled by the imaging control unit 312.

The nail image imaged by the imaging device 51 is acquired by the imaging control unit 312 and appropriately transmitted to the cooperating terminal device 7.

Note that image data of the image captured by the imaging unit 50 may be stored in a storage unit 32 to be described later.

Although the case where the imaging device 51 and the illumination device 52 are fixedly arranged at positions that can face the nail of the finger (the surface of the nail) placed on the finger holder 6 or the surface of the adjustment paper P inside the top surface of the housing 2 is illustrated in the present embodiment, it suffices that the imaging unit 50 is provided at a position where the nail of the finger placed on the finger holder 6 or the surface of the adjustment paper P (print target surface) can be imaged, and a specific arrangement thereof is not particularly limited.

For example, the imaging unit 50 may be configured to be movable in the XY directions by the head movement mechanism 49 that moves the print head 41.

The control device 30 installed on the printing apparatus 1 is a computer that includes a control unit 31 (see FIG. 2) configured using a processor such as a central processing unit (CPU) (not illustrated), and the storage unit 32 (see FIG. 2) including a read only memory (ROM), a random access memory (RAM), and the like (none of which are illustrated).

The storage unit 32 has a program storage area 321 in which various programs and the like for operating the printing apparatus 1 are stored. The program storage area 321 stores various programs such as a print program for performing a printing process, and the respective units of the printing apparatus 1 are integrally controlled as the control unit 31 develops these programs in, for example, a work area of the RAM and the control unit 31 executes the programs.

The control unit 31 includes a communication control unit 311, the imaging control unit 312, the printing control unit 313, and the like in terms of functions. The functions of the communication control unit 311, the imaging control unit 312, the printing control unit 313, and the like are realized by cooperation between the control unit 31 and the programs stored in the program storage area 321 of the storage unit 32.

The communication control unit 311 controls an operation of a communication unit 13.

The communication unit 13 includes a wireless communication module and the like that can communicate with a communication unit 73 of the terminal device 7, and the communication control unit 311 controls the operation of the communication unit 13 when various types of data and the like are transmitted and received between the printing apparatus 1 and the terminal device 7.

The printing apparatus 1 of the present embodiment is configured to print a nail design (hereinafter, it is also simply referred to as "design") in cooperation with the terminal device 7 to be described later. For example, data of the design to be printed on the nail T is stored on the terminal device 7 side, and the communication control unit 311 appropriately controls communication performed by the communication unit 13 and acquires the data of the design from the terminal device 7 side via the communication unit 13.

As will be described later, an image acquired by the imaging unit 50 of the printing apparatus 1 is appropriately transmitted to the terminal device 7, and the control unit 81 (a nail information detection unit 813 to be described later) of the terminal device 7 detects various types of nail information based on the captured image. In the present embodiment, the control unit 81 (a print data generation unit 814 described later) of the terminal device 7 generates print data based on the nail information. Various pieces of information detected on the terminal device 7 side, the generated print data, and the like are transmitted from the terminal device 7 to the printing apparatus 1 via the communication units 13 and 73.

The communication between the printing apparatus 1 and the terminal device 7 may use a network line such as the Internet, or may perform wireless communication based on a short-range wireless communication standard such as Bluetooth (registered trademark) and Wi-Fi. When communication is performed via a network, any line may be used as the network used for communication. In addition, the communication between the printing apparatus 1 and the terminal device 7 is not limited to wireless communication, and a configuration in which various types of data can be transmitted and received between the printing apparatus 1 and the terminal device 7 by wired connection may be adopted.

Note that it suffices that the communication unit 13 can communicate with the terminal device 7, and one that conforms to a communication standard of the communication unit 73 of the terminal device 7 is applied.

The imaging control unit 312 controls the imaging device 51 and the illumination device 52 of the imaging unit 50 to cause the imaging device 51 to capture the image of the finger (nail image) including the image of the nail of the finger placed on the finger holder 6 and the paper image which is the image of the adjustment paper P.

In the present embodiment, undercoating is printed on a natural nail, and then, the nail in the state of being coated with the undercoating is imaged by the imaging unit 50 before printing a design to acquire an image (nail image) of the nail.

In addition, the surface of the adjustment paper P is imaged by the imaging unit 50 as will be described later, and the image (paper image) of the adjustment paper P is acquired.

The image of the nail T (nail image) and the image of the adjustment paper P (paper image) acquired by the imaging unit 50 are sent to the imaging control unit 312. The imaging control unit 312 acquires data of these images (nail image and paper image). Note that the imaging control unit 312 may store the nail image and the paper image in the storage unit 32.

The printing control unit 313 outputs print data generated by the print data generation unit 814, which will be described later, to the printing unit 40, and controls the printing unit 40 to perform printing on the nail according to the print data.

Specifically, the printing control unit 313 outputs a control signal to the printing unit 40 based on the print data, and controls the X-direction movement motor 46, the Y-direction movement motor 48, the print head 41, and the like of the printing unit. 40 to perform printing according to the print data on the nail.

In the present embodiment, the printing control unit 313 is a control unit configured to control the print head 41 and the other printing unit 40, and causes the print head 41 to print the correction pattern M for performing alignment, correction.

In this case, the printing control unit 313 operates a first head, configured to print a first color distinguishable from a surface color of the adjustment paper P as the print target surface, to print a first correction pattern M1 for performing alignment correction of the first head on the adjustment paper P as the print target surface, and further operates a second head, configured to print a second color distinguishable from the first color, to print a second correction pattern M2 for performing alignment correction of the second head on the adjustment paper P as the print target surface so as to at least partially overlap a first color area Ar1 that is an area on which the first correction pattern M1 has been printed or an area formed by the first head including the first correction pattern M1.

Specifically, the printing control unit 313 sets a target print position here the correction pattern M is to be printed in advance at any position on the adjustment paper P as the print target surface.

Then, the first correction pattern M1 for performing alignment correction of the design head 41*b* is printed on the adjustment paper P by a print head (for example, the design head 41*b* that performs color printing in the case of white adjustment paper P) that prints a color (first color) that can be distinguished from the surface color of the adjustment paper P. Then, the second correction pattern M2 for performing alignment correction of the undercoating head 41*a* is printed by a print head (for example, the undercoating head 41*a* that performs printing using a white ink or the like in a case where the first correction pattern M1 has been printed in black or the like by the design head 41*b*) that prints a color (second color) that can be distinguished from the color (first color) with which the first correction pattern M1 has been printed.

Note that what kind of pattern is to be printed on the adjustment paper P as each correction pattern M (M1 or M2), and a target print position (coordinates of a position to be printed or the like) may be stored as data in the storage unit 32 or the like, or the data may be appropriately transmitted from the terminal device 7. The printing control unit 313 prints the correction pattern M (M1 or M2) based on this data.

A printing result on the adjustment paper P is imaged by the imaging unit 50 to acquire a paper image. The acquired paper image is transmitted to the terminal device 7.

In a case where the first color area, which is the area formed by the first head, is an area where the first correction pattern. M1 is to be printed (a print range of the first correction pattern M1) (that is, when the second correction pattern M2 is printed so as to at least partially overlap the print range of the first correction pattern M1), it is necessary to determine the print range for printing the first correction pattern M1 at the time of printing the first correction pattern M1 in consideration of how much printing by the first head and the second head is likely to deviate from a target print position (target coordinates) that is to be originally printed at most.

Therefore, the printing control unit 313 which is the control unit, controls the first head to print the first correction pattern M1 for performing alignment correction of the first head, which is printed based on a range (which is hereinafter referred to as an "alignment adjustment range") that can be handled by the alignment correction out of the "amount of possible deviation" (the amount of deviation when a print position deviates to the maximum extent) in which print positions of the respective print heads 41 (first head and second head) are likely to deviate, at a predetermined position on the print target surface with the first color distinguishable from the surface color of the print target surface, and then, controls the second head to print the second correction pattern M2 for performing alignment correction of the second head at a predetermined position on the print target surface with the second color distinguishable from the first color.

Since such a method is adopted, the second correction pattern M2 can be printed so as to at least partially overlap the first correction pattern M1.

Details thereof will be described later with reference to FIG. 4.

Figure 4:
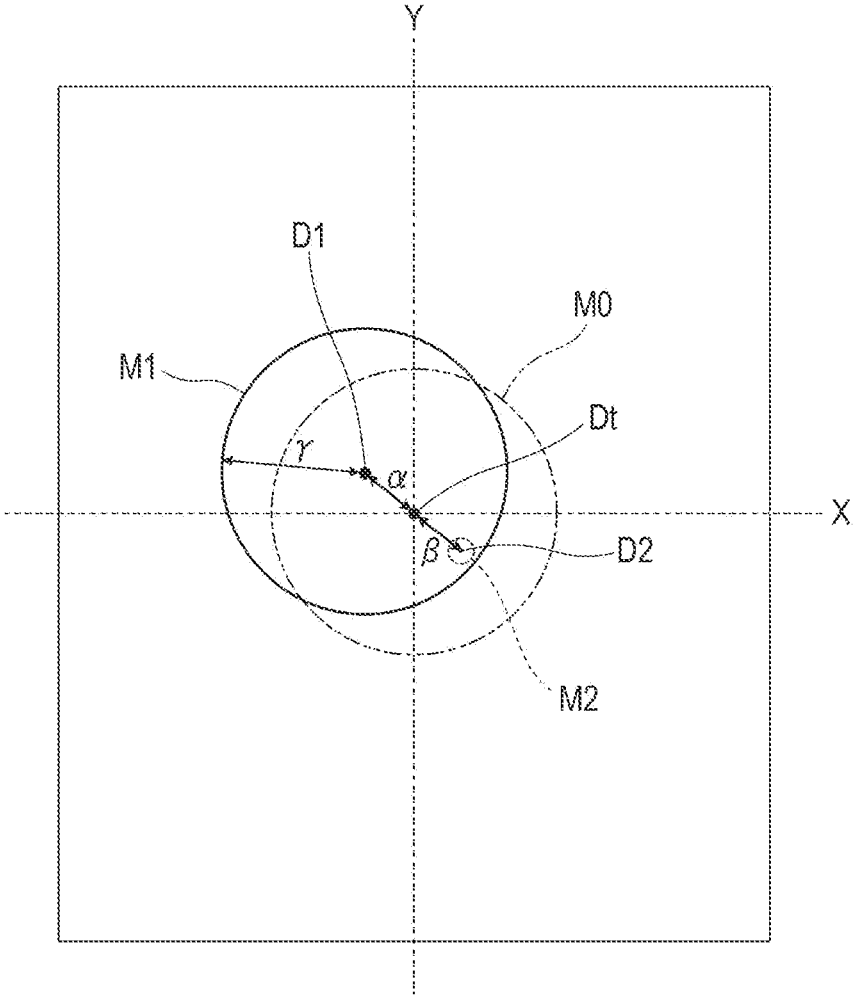
FIG. 4 is an explanatory view for describing setting of a print range of a first correction pattern.

For example, in a case where the first correction pattern M1 in black, red, or the like is printed on the white adjustment paper P using the design head 41*b* and the second correction pattern M2 is printed by the second head (for example, the undercoating head 41*a*) so as to at least partially overlap the print range of the first correction pattern M1, each of the print heads 41 (first head and second head) is likely to perform printing at a position deviating from the target print position (target coordinates) as illustrated in FIG. 4. This deviation of the print position occurs due to, for example, a mounting error at the time of assembly, a mounting error when the user replaces the print head 41, and the like.

The amount of positional deviation of the print head 41 caused by such factors is assumed to some extent in advance. If a deviation more than the assumption occurs, it is necessary to take a mechanical measure such as asking the user to correctly mount the print head 41 again. On the other hand, if a deviation falls within the assumed range, for example, it is possible to take a measure in terms of software by detecting the amount of deviation is detected from an image obtained by imaging an actually printed result by the imaging device 51 and performing alignment correction such as changing a print timing of the print head 41 based on the detection result.

In the present embodiment, the first correction pattern M1 is printed based on the "alignment adjustment range" which is a range that can be handled by alignment correction in this manner out of the "amount of possible deviation" (the amount of deviation when the print position deviates to the maximum extent) of each of the print heads 41 (the first head and the second head).

FIG. 4 illustrates a case where the first head prints the circular first correction pattern M1 on the print target surface with the first color. In this case, a target print position (target coordinates) of the first head is a predetermined circular range (print range M0 indicated by a two-dot chain line in FIG. 4) having an intersection point Dt between the X axis and the Y axis as the center, which is a print range of the first correction pattern M1 that is to be originally printed.

However, there is a possibility that printing deviating from the target print position is performed with the first head (the maximum deviation amount of a print position is referred to as the "amount of possible deviation"). An alignment adjustment range which is a range that can be handled by alignment correction out of the "amount of possible deviation" is denoted by "$\alpha$".

If the print position of the first head deviates by $\alpha$, the first correction pattern M1 that is actually printed is a predetermined circular range (range indicated by a thick solid line in FIG. 4) having a point D1 deviating from the intersection point Dt between the X axis and the Y axis by $\alpha$ as the center.

Meanwhile, in a case where the second head prints the circular second correction pattern M2 on the print target surface with the second color, a target print position is a predetermined circular range having the intersection point Dt between the X axis and the Y axis as the center in FIG. 4 similarly to the first head, which is a print range of the second correction pattern M2 that is to be originally printed.

However, there is also a possibility that printing deviating from the target print position is performed with the second head. An alignment adjustment range which is a range that can be handled by alignment correction out of the "amount of possible deviation" that is the maximum deviation amount of the print position is denoted by "$\beta$".

If the print position of the second head deviates by $\beta$, the second correction pattern M2 that is actually printed is a predetermined circular range (range indicated by a thick broken line in FIG. 4) having a point D2 deviating from the intersection point Dt between the X axis and the Y axis by $\beta$ as the center.

If the deviation $\alpha$ and the deviation $\beta$ are deviations oriented in the same direction from the intersection point Dt between the X axis and the Y axis, there is a high possibility that the first correction pattern M1 and the second correction pattern M2 at least partially overlap each other even if the both are printed in any size and shape.

However, in a case where the deviation $\alpha$ and the deviation $\beta$ are deviations oriented in different directions from the intersection point Dt between the X axis and the Y axis (for example, in a case where vectors are diametrically opposite) as illustrated in FIG. 4, it is also assumed that the second correction pattern M2 does not overlap the first correction pattern M1 at all unless the print range of the first correction pattern M1 is set in consideration of the deviation $\alpha$ and the deviation $\beta$ (based on the deviation $\alpha$ and the deviation $\beta$).

In this regard, if a range having a length, equal to or longer than the sum of the deviation $\alpha$ of the print position from the target print position in the first head (the alignment adjustment range of the first head) and the deviation $\beta$ of the print position from the target print position in the second head (the alignment adjustment range of the second head), as a radius $\gamma$ (that is, $\gamma \geq \alpha+\beta$) is set as the print range of the first correction pattern M1, at least a part of the second correction pattern M2 overlaps the first correction pattern M1 regardless of the direction and amount of deviation of the print position of each of the print heads 41 (the first head and the second head).

Therefore, the white second correction pattern M2 is not directly printed on the white adjustment paper P by the undercoating head 41*a*, the position where the second correction pattern M2 has been printed can be recognized from the paper image obtained by imaging the adjustment paper P, and an alignment value can be appropriately obtained.

Although the case where the print range of the second correction pattern M2 is considerably smaller than the print range of the first correction pattern M1 and the entire print range of the second correction pattern M2 falls within and entirely overlaps the print range of the first correction pattern M1 has been given as an example in FIG. 4, it suffices that at least a part of the second correction pattern M2 overlaps the first correction pattern M1, and is not limited to the case of entirely overlapping the first correction pattern M1 as in the example illustrated in FIG. 4.

The amount of the second correction pattern M2 overlapping the first correction pattern M1 that enables the alignment value for performing the alignment correction of the second head to be obtained differs depending on a shape of a correction pattern, the imaging accuracy of a paper image obtained by imaging the adjustment paper P on which the correction pattern has been printed, the analysis accuracy of analyzing the paper image, and the like.

For example, in the case where the correction patterns are circular as illustrated in FIG. 4, the points D1 and D2 as the centers thereof are acquired, and coordinates of the points D1 and D2 are compared with the point Dt as the target coordinates. As a result, the amount of deviation between each of the points D1 and D2 and the point Dt can be grasped, and the alignment value of each of the print heads 41 can be obtained.

In this case, it is desirable that the point D2, which is the center of the second correction pattern M2, be within the print range of the first correction pattern Mt, but it suffices that only a part of the circle of the second correction pattern M2 not including the point D2 overlaps the print range of the first correction pattern M1, for example, when an arc of the outer periphery of the second correction pattern M2 overlaps the print range of the first correction pattern M1 to such an extent that the point D2 that is the center of the circle can be determined. In this case, the printing control unit 313 can obtain the coordinates of the point D2 and grasp the amount of deviation from the point Dt, which is the target coordinates, thereby obtaining the alignment value of the print head 41.

In addition, if two or more points in correction pattern figures can be determined for the first correction pattern M1 and the second correction pattern M2, a rotation angle of the print head 41 can also be detected. In this case, an alignment value for the rotation angle of the print head 41 can be obtained.

As described above, the printing apparatus 1 of the present embodiment performs printing on the nail in cooperation with the terminal device 7.

The terminal device 7 is, for example, a mobile terminal device such as a smartphone. Note that the terminal device 7 is not limited to the smartphone. For example, the terminal device 7 may be a tablet personal computer (hereinafter, referred to as "PC"), a notebook PC, a stationary PC, a terminal device for a game, or the like.

As illustrated in FIG. 2, the terminal device 7 includes an operation unit 71, a display unit 72, a communication unit 73, a control device 80, and the like.

The operation unit 71 is configured to enable various inputs, settings, and the like according to user's operations, and is, for example, a touch panel integrally provided on the surface of the display unit 72. When the operation unit 71 is operated, an input signal corresponding to the operation is transmitted to the control unit 81.

Various operation screens are displayed on the touch panel configured by the display unit 72 under control of a display control unit 812, which will be described later, and the user can perform various operations such as inputs and settings by a touch operation on the touch panel.

Note that the operation unit 71 configured to perform various operations such as inputs and settings is not limited to the touch panel. For example, various operation buttons, a keyboard, a pointing device, or the like may be provided as the operation unit 71.

In the present embodiment, various instructions such as printing start are output from the terminal device 7 to the printing apparatus 1 as the user operates the operation unit 71, so that the terminal device 7 also functions as an operation unit of the printing apparatus 1.

In addition, the user can select the nail design (design) to be printed on the nail by operating the operation unit 71.

The display unit 72 is configured using, for example, a liquid crystal display (LCD), an organic electroluminescence display, or another flat display.

As described above, a touch panel configured to perform various inputs may be integrally formed on the surface of the display unit 72. In this case, the touch panel functions as the operation unit 71.

In the present embodiment, the nail design input and selected by the user from the operation unit 71, various guidance screens, a warning display screen, and the like can be displayed on the display unit 72.

The communication unit 73 is configured to be capable of communicating with the communication unit 13 of the printing apparatus 1.

As described above, the communication between the printing apparatus 1 and the terminal device 7 may adopt either a wireless connection system or a wired connection system, and a specific system thereof is not limited. It suffices that the communication unit 73 can communicate with the printing apparatus 1, and one that conforms to a communication standard of the communication unit 13 of the printing apparatus 1 is applied.

The communication unit 73 is connected to a communication control unit 811 (see FIG. 2) of the control device 80, which will be described later, and is controlled by the communication control unit 811.

As illustrated in FIG. 2, the control device. 80 of the terminal device 7 of the present embodiment is a computer including the control unit 81 configured using a processor such as a central processing unit (CPU) (not illustrated), and a storage unit 82 configured using a read only memory (ROM), a random access memory (RAM), and the like (not illustrated).

The storage unit 82 stores various programs, various types of data, and the like to operate the respective units of the terminal device 7.

Specifically, the ROM or the like of the present embodiment stores not only an operation program 821*a* for integrally controlling the respective units of the terminal device 7 but also various programs such as a nail printing application program 821*b* (hereinafter referred to as "nail print AP") for performing nail printing using the printing apparatus 1. Thus, the control unit 81 develops these programs in, for example, a work area of the RAM, and the respective units of the terminal device 7 are integrally controlled as the programs are executed by the control unit 81.

In addition, the storage unit 82 of the present embodiment is provided with a design storage area 822 for storing data of the nail design (design), a nail information storage area 823, and the like. The nail information storage area 823 stores various types of information regarding the nail detected by the nail information detection unit 813 to be described later.

Note that the nail design (design) stored in the design storage area 822 may be an existing design prepared in advance or a design created directly by the user. In addition, when the terminal device 7 can be connected to various networks, it may be configured such that a nail design (design), stored in a server device (not illustrated) or the like connectable to the network, can be acquired.

The control unit 81 of the terminal device 7 includes the communication control unit 811, the display control unit 812, the nail information detection unit 813, the print data generation unit 814, and the like in terms of functions. The functions as the communication control unit 811, the display control unit 812, the nail information detection unit 813, the print data generation unit 814, and the like are realized by cooperation between the CPU of the control unit 81 and the programs stored in the ROM of the storage unit 82. Note that the functions of the control unit 81 of the terminal device 7 are not limited thereto, and may include other various functional units.

The communication control unit 811 controls the operation of the communication unit 73.

In addition, the display control unit 812 controls the display unit 72 to display various display screens on the display unit 72.

The nail information detection unit 813 is a control unit configured to detect the nail information on a nail based on an image of the nail mail image) acquired by the imaging control unit 312 of the printing apparatus 1. In the present embodiment, the nail information detection unit 813 detects contour information of the nail defining an area of the nail as the nail information.

Note that the nail information detected by the nail information detection unit 813 is not limited thereto.

Examples of the nail information detected by the nail information detection unit 813 may include an inclination angle (a nail inclination angle and a nail curvature) of a surface of a nail with respect to the XY plane, in addition, in a case where a height of the nail T (a position of the nail in the vertical direction) can be acquired from an image or the like imaged by the imaging device 51, the height of the nail may also be included in the nail information.

Various pieces of information detected by the nail information detection unit 813 are stored in the nail information storage area 823. In the present embodiment, various types of information detected by the nail information detection unit 813 may be sent to the printing apparatus 1. Note that various processes based on the nail information may be performed on the printing apparatus 1 side.

The print data generation unit 814 generates print data by aligning a desired design with a nail area (print area) detected by the nail information detection unit 813.

Specifically, the print data generation unit 814 cuts out image data of the nail design (design) selected by the user and performs fitting in the nail area (print area) detected from the nail image while appropriately performing scaling, arrangement adjustment, and the like.

In the present embodiment, the print data generation unit 814 includes an alignment correction unit 815 configured to perform alignment correction for each of the print heads 41.

In a case where the correction pattern M for performing alignment correction in the printing apparatus 1 is printed and an image (paper image) of the adjustment paper P on which the correction pattern M has been printed is acquired, the alignment correction unit 815 acquires information on a deviation between a position of the actually printed correction pattern M (which is referred to as an "actual print position") and a target print position that is to be originally printed, acquired based on the paper image, as correction information (which is referred to as an "alignment value").

When the alignment correction unit 815 acquires the alignment value, the print data generation unit 814 applies the alignment value (correction information) to perform alignment correction of a print position in a post-print operation, and generates print data reflecting the alignment correction.

In a case where the nail information detection unit 813 acquires the curvature of the nail or the like, the print data generation unit 814 may appropriately perform curved surface correction on the print data based on the curvature of the nail or the like. When the curved surface correction is performed, the print data more suitable for the shape of the nail can be generated.

Note that a specific method and procedure in the case of performing alignment correction will be described later.

Next, a printing control method of the printing apparatus 1 of the present embodiment will be described with reference to FIG. 5 and the like.

Figure 5:
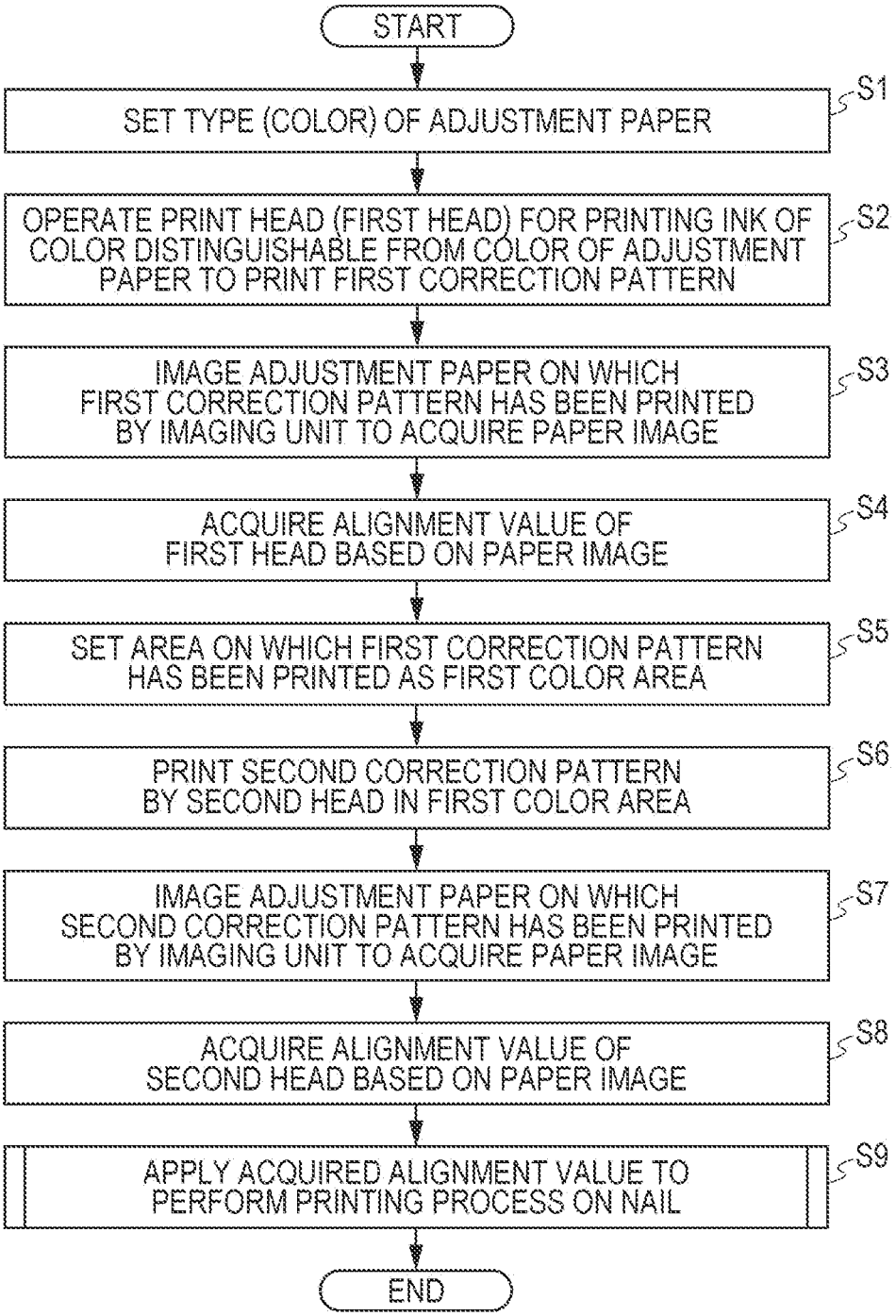
FIG. 5 is a flowchart illustrating a printing control process according to the present embodiment.

FIG. 5 is a flowchart illustrating a printing control process in the present embodiment.

When nail printing is performed using the printing apparatus 1 of the present embodiment, the user first attaches the print head 41 (the undercoating head 41*a* and the design head 41*b*) to the carriage 42.

Then, the user operates the operation unit 12 (operation button) or the like of the printing apparatus 1 to turn on the power and activate the printing apparatus 1. In addition, the terminal device 7 is also turned on, and execution of a nail printing process is selected through the operation unit 71 of the terminal device 7. As a result, the nail print AP 821*b* is activated.

In the present embodiment, alignment correction is performed so as not to cause a deviation in a print position when the print head 41 has been replaced, for example. Therefore, for example, if the nail print AP 821*b* is activated in the terminal device 7, the display control unit 812 of the terminal device 7 causes the display unit 72 to display a message prompting the user to prepare to print the correction pattern M for the alignment correction.

For example, if a message such as "please set adjustment paper" is displayed, the user mounts the paper arrangement member 67 on which the adjustment paper P has been set onto the main body of the finger holder 6.

When the adjustment paper P is set at a predetermined position, the imaging control unit 312 of the printing apparatus 1 operates the imaging unit 50 to image the adjustment paper P and acquire a paper image. The paper image is sent to the terminal device 7, subjected to image processing in the control unit 81 of the terminal device 7, and a type (color) of the adjustment paper P is read and set (Step S1). Note that the color of the adjustment paper P may be set by a user's input operation. For example, if the user sets the white adjustment paper P and inputs this information through the operation unit 71 or the like, the setting may be performed such that the color of the adjustment paper P is the white paper based on the input information.

Figure 6A:
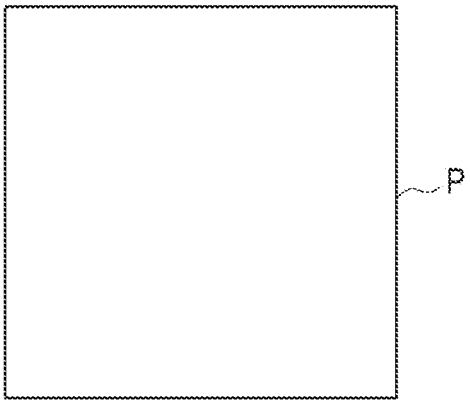
FIG. 6A illustrates an example of white adjustment paper.

If the color of the adjustment paper P is set, the alignment correction unit 815 determines the print head 41 (first head) that prints an ink of a color distinguishable from the color of the adjustment paper P. For example, in a case where the white adjustment paper P is set as illustrated in FIG. 6A, the alignment correction unit 815 determines the design head 41*b* that performs color printing as a first head. Then, information on the determined print head 41 (first head) and information on the correction pattern M (first correction pattern M1) for alignment correction and a target print position where the correction pattern M is to be printed (absolute coordinates of a print position, coordinates indicating a contour of a correction pattern RM in a case where printing is performed at the target print position indicated by a broken line in FIGS. 6D and 6E and coordinates (Ax, Ay) of a center point Ad thereof) are transmitted to the printing apparatus 1.

When receiving the information from the alignment correction unit 815, the printing control unit 313 of the printing apparatus 1 operates the design head 41*b* (first head) to print the first correction pattern M1 at the target print position on the adjustment paper P (Step S2). As a result, the first correction pattern M1 for performing alignment correction of the design head 41*b* (first head) is printed on the adjustment paper P (see FIG. 6B).

As described above, the first correction pattern M1 is printed based on an alignment adjustment range which is a range that can be handled by the alignment correction out of the "amount of possible deviation" indicating how much printing by the print head 41 (first head and second head) is likely to deviate from the target print position (the target coordinates, the point Dt in FIG. 4) that is to be originally printed at most. The print range of the first correction pattern M1 is appropriately set based on the alignment adjustment range.

As a result, the second correction pattern M2 is printed so as to at least partially overlap the print range of the first correction pattern M1 regardless of the direction and amount of deviation of the print position of the print head 41 (first head and second head).

For example, when the first correction pattern M1 is circular, the radius $\gamma$ of the circle is the length equal to or longer than the sum of the deviation $\alpha$ of the print position from the target print position in the first head (the alignment adjustment range of the first head) and the deviation $\beta$ of the print position from the target print position in the second head (the alignment adjustment range of the second head). When the radius $\gamma$ of the circle of the first correction pattern M1 is set to "$\gamma \geq \alpha+\beta$" in this manner, the point D2 (see FIG. 4) as the center of the second correction pattern M2 can be reliably arranged within the print range of the first correction pattern M1.

If the first correction pattern M1 is printed, the imaging control unit 312 operates the imaging unit 50 to image the adjustment paper I' after the printing to acquire a paper image (Step S3).

The paper image is transmitted to the terminal device 7, and the alignment correction unit 815 acquires an alignment value of the first head based on the paper image (Step S4).

Figure 6B:
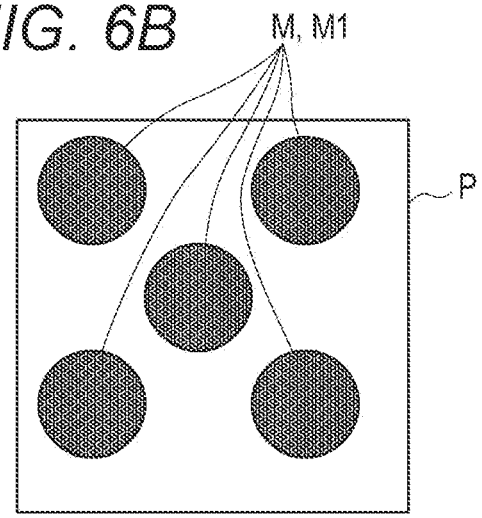
FIG. 6B is a plan view illustrating a state where a first correction pattern is printed on the adjustment paper.
Figure 6C:
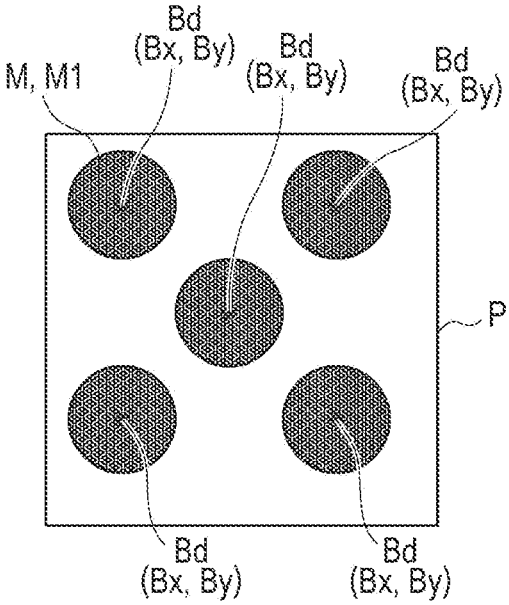
FIG. 6C is a view illustrating coordinates of a center of the first correction pattern.

Specifically, first, the alignment correction unit 815 performs image processing on the paper image to obtain coordinates of a center point Bd (D1 in FIG. 4) of the actually printed first correction pattern M1. For example, in a case where five circular first correction patterns M1 are printed as illustrated in FIG. 6B, coordinates (Bx, By) of the center points, Bd of the respective circles are obtained as illustrated in FIG. 6C. Note that the shape of the correction pattern M (M1 or M2) is not limited to the circle, and may be various polygons such as a triangle and a quadrangle, various characters, numbers, symbols, and the like. A method of the image processing for obtaining the coordinates of the center point Bd and the like from the paper image is not particularly limited, and various types of software and the like can be used.

Then, the coordinates (Ax, Ay) of the center point Ad (Dt in FIG. 4) of the correction pattern RM at the time of being printed at the target print position and the coordinates (Bx, By) of the center point Bd of the actually printed first correction pattern M1 at the time of being actually printed, obtained based on the paper image, are compared (see FIG. 6E) to acquire the amount of deviation therebetween as an alignment value.

Specifically, the alignment correction unit 815 calculates "Ax−Bx=Cx" from the X-direction coordinate Ax of the center point Ad and the X-direction coordinate Bx of the center point Bd to obtain an alignment value Cx in the X direction. In addition, the alignment correction unit 815 calculates "Ay−By=Cy" from the Y-direction coordinate Ay of the center point Ad and the Y-direction coordinate By of the center point Bd to obtain an alignment value Cy in the Y direction.

Figure 6D:
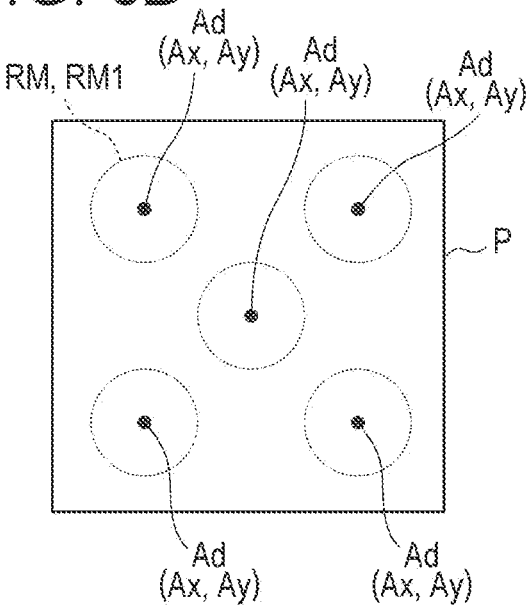
FIG. 6D is a view illustrating a target print position of the first correction pattern.
Figure 6E:
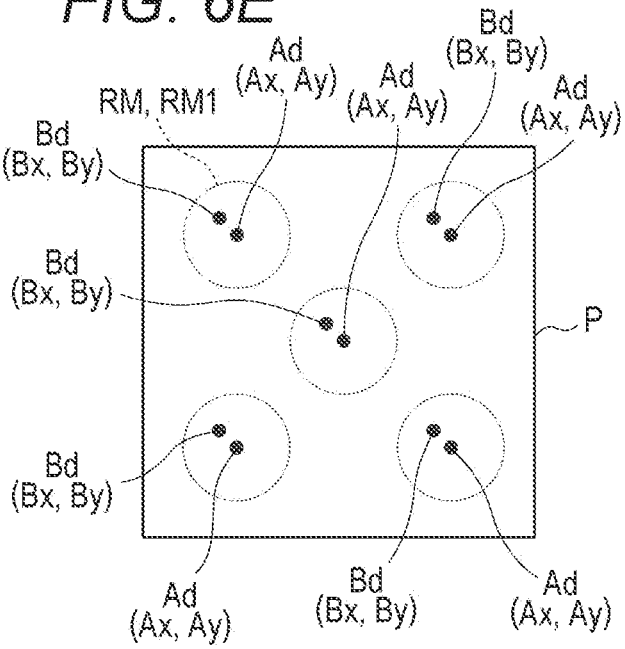
FIG. 6E is an explanatory view illustrating a deviation between coordinates of a center of an actual print position of the first correction pattern and the coordinates of a center of the target print position.

Note that when a plurality of correction patterns M (M1 and M2) are printed (five circles in the illustrated example) to obtain a plurality of center points Bd as illustrated in FIGS. 6D and 6E, a distance between the center points Bd can be obtained. As the distance between the center points Bd is compared with a distance between the corresponding center points Ad, it is also possible to obtain information on whether the distance between the center points Bd is longer or shorter than the distance between the center points Ad that is to be originally printed. Based on the information, it is possible to acquire the amount of deviation of a height position (that is, a distance to the print target surface, that is, whether the imaging device 51 is installed on the upper part or the lower part in the apparatus) of the imaging device 51 that has acquired the paper image.

Further, the degree of rotation (installation angle) of the imaging device 51 can also be acquired by acquiring the amount of deviation in inclination between a straight line in a case of connecting the center points Bd and a straight line in a case of connecting the corresponding center points Ad.

The imaging device 51 (camera) of the imaging unit 50 provided in the printing apparatus 1 has some errors at the time of assembly. When the plurality of correction patterns M (M1 and M2) are printed to obtain the respective center points Bd, not only the positional deviation of the print head 41 but also the installation error of the imaging device 51 can also be acquired, and the more accurate printing process can be performed by performing correction based on these pieces of information.

Figure 7A:
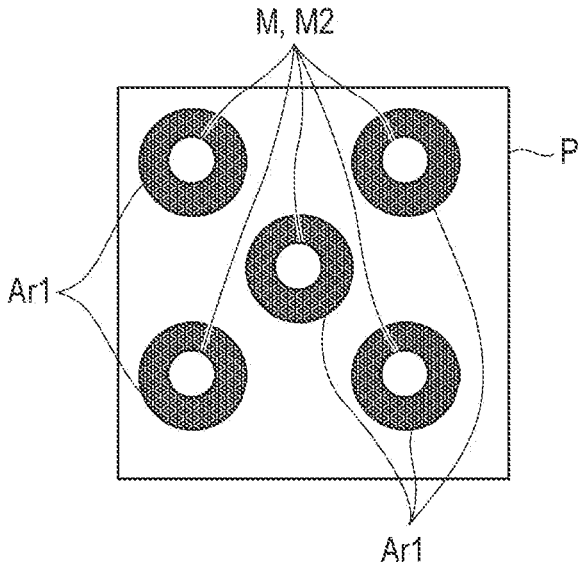
FIG. 7A is a plan view illustrating a state where a second correction pattern is printed using an area on which the first correction pattern has been printed as a first color area.

Returning to FIG. 5, next, the alignment correction unit 815 sets an area on which the first correction pattern M1 has been printed as the first color area Ar1 (see Step S5 and FIG. 7A).

Figure 7B:
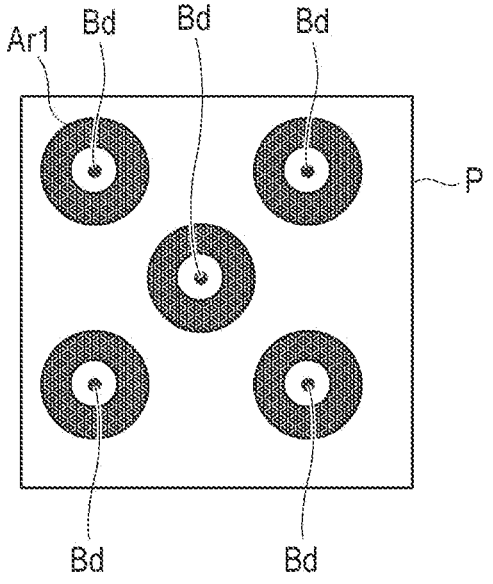
FIG. 7B is a view illustrating a center of the second correction pattern.

Then, the second correction pattern M2 is printed in the first color area Ar1 by the second head (the undercoating head 41*a* that performs printing with a color distinguishable from the first color in the case of the present embodiment) (Step S6, see FIGS. 7A and 7B).

Specifically, the alignment correction unit 815 transmits information on the print head 41 (second head) and information on the second correction pattern M2 for alignment correction and a target print position where the second correction pattern M2 is to be printed (absolute coordinates of a print position) to the printing apparatus 1 similarly to the case of first printing the first correction pattern M1.

When receiving the information from the alignment correction unit 815, the printing control unit 313 of the printing apparatus 1 operates the undercoating head 41*a* (second head) to print the second correction pattern M2 at the target print position on the adjustment paper P. As a result, the second correction pattern M2 for performing alignment correction of the undercoating head 41*a* (second head) is printed on the adjustment paper P (see FIG. 7A).

If the second correction pattern M2 is printed, the adjustment paper P after printing is imaged by the imaging unit 50 to acquire a paper image (Step S7).

The paper image of the adjustment paper P on which the second correction pattern M2 has been printed is transmitted to the terminal device 7, and the alignment correction unit 815 acquires an alignment value of the undercoating head 41*a* (second head) based on the paper image (Step S8).

Even in this case, the coordinates (Bx, By) of the center point Bd (D2 in FIG. 4) of the second correction pattern M2 (five circles each of which is slightly smaller than a range set as the first color area Ar1 in the example illustrated in FIG. 7B) are obtained as illustrated in FIG. 7B, and are compared with coordinates of a center point (Dt in FIG. 4) in a case where the second correction pattern M2 is printed at the target print position to calculate an alignment value. Note that a specific calculation method is similar to that in the case of obtaining the alignment value from the first correction pattern M1, and thus, the description thereof will be omitted.

If the alignment value is acquired for the print head 41, the print data generation unit 814 generates print data of a design to be printed on a nail. When generating the print data, the print data generation unit 814 appropriately performs correction (for example, curved surface correction or the like) based on nail information acquired by the nail information detection unit 813, and applies the acquired alignment value.

The print data generated by the print data generation unit 814 is transmitted to the printing apparatus 1, and the printing apparatus 1 performs the printing process on the nail according to the print data (Step S9).

Note that a series of methods described above is substantially the same even in a case where the adjustment paper P has a color other than white, except that the print order of the print heads 41 is reversed.

Figure 8A:
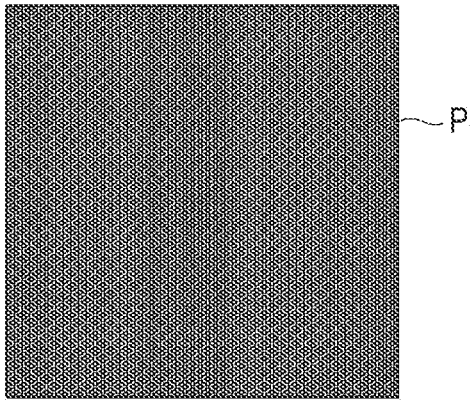
FIG. 8A is a plan view illustrating an example of black adjustment paper.
Figure 8B:
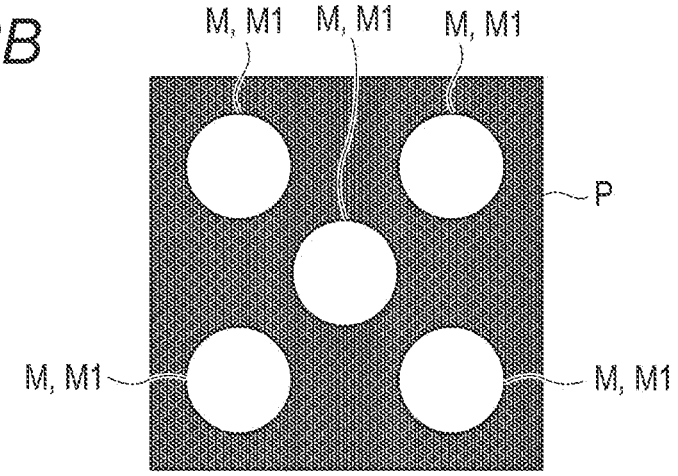
FIG. 8B is a plan view illustrating a state where a first correction pattern is printed on the adjustment paper.

That is, for example, in a case where the black adjustment paper P is set as illustrated in FIG. 8A, the alignment correction unit 815 determines, as a first head, the undercoating head 41*a* that performs undercoating printing with an ink (white or the like) of a color (first color) distinguishable from the black color of the adjustment paper P. Then, in the printing apparatus 1, the determined print head 41 (undercoating head 41*a* as the first head) is operated to print the correction pattern M (first correction pattern M1) for performing alignment correction of the undercoating head 41*a* (first head) on the adjustment paper P with an undercoating ink of white or the like (see FIG. 8B). Then, an alignment value of the undercoating head 41*a* (first head) is acquired based on a paper image of the adjustment paper P on which the first correction pattern M1 has been printed.

Figure 8C:
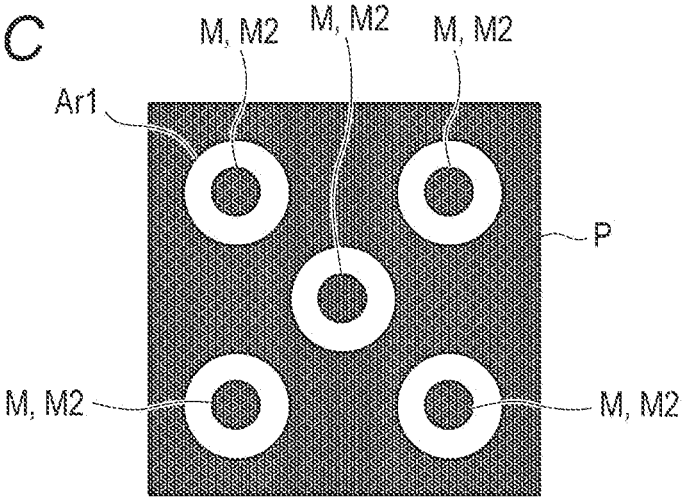
FIG. 8C is a plan view illustrating a state where a second correction pattern is printed using an area on which the first correction pattern has been printed as a first color area.

Next, the user operates the design head 41*b* (second head), which prints a second color (for example, black) distinguishable from the first color (white or the like), to print the second correction pattern M2 for performing alignment correction of the design head 41*b* (second head) in the first color area Ar1 (circular area painted in white in FIG. 8B), which is an area where the first correction pattern M1 has been printed, on the surface of the adjustment paper P (see FIG. 8C). Then, an alignment value of the design head 41*b* (second head) is acquired based on a paper image of the adjustment paper P on which the second correction pattern M2 has been printed.

In this manner, the first correction pattern M1 by the undercoating head 41*a* and the second correction pattern M2 by the design head 41*b* can be printed on one adjustment paper P, and the alignment values of the respective print heads 41 can be obtained in the present embodiment. Therefore, even when the plurality of print heads 41 for printing mutually different colors are provided, it is unnecessary to prepare sheets of the adjustment paper P having different colors corresponding to the respective print heads 41. In addition, the second correction pattern M2 can be printed without replacing the adjustment paper P after printing the first correction pattern M1, and thus, the continuous printing operation becomes possible, and the alignment values for the plurality of print heads 41 can be smoothly and quickly acquired.

As described above, according to the present embodiment, the printing apparatus 1 that performs printing on the print target surface, such as the nail surface and the surface of the adjustment paper P, includes: the plurality of print heads 41 configured to print mutually different colors; and the control unit 31 (printing control unit 313) that controls these print heads 41. The control unit 31 (printing control unit 313) operates the first head (for example, the design head 41*b*), configured to print the first color (for example, black) distinguishable from the surface color of the adjustment paper P that is the print target surface, to print the first correction pattern. M1 for performing alignment correction of the first head (for example, the design head 41*b*) on the adjustment paper P, and then, operates the second head (for example, the undercoating head 41*a*), configured to print the second color (for example, white) distinguishable from the first color (for example, black), to print the second correction pattern M2 for performing alignment correction of the second head (for example, the undercoating head 41*a*) on the adjustment paper P so as to at least partially overlaps the first color area Ar1.

As a result, the correction patterns M for the plurality of print heads 41 can be printed on the same print target surface, and it is unnecessary to prepare different adjustment paper P so as to correspond to the respective print heads 41. Therefore, it is sufficient to prepare one type of adjustment paper P, which is excellent in cost performance. In addition, every time the correction pattern M is printed by a different print head 41, it is possible to save time and effort for replacement with the adjustment paper P having a color corresponding to an ink to be printed by the print head 41, so that the alignment value for each of the print heads 41 can be smoothly and quickly acquired. Then, the high-quality nail printing can be realized by appropriately acquiring the alignment value for each of the print heads 41.

In particular, when the first color area Ar1 is the area where the first correction pattern M1 has been printed by the first head (for example, the design head 41*b*) as in the present embodiment, it is unnecessary to additionally perform printing for forming the first color area Ar1. Therefore, the first correction pattern M1 and the second correction pattern M2 used for alignment correction of each of the print heads 41 can be efficiently printed while eliminating waste of ink.

In the present embodiment, the print target surface when the first correction pattern M1 and the second correction pattern M2 are printed is the surface of the predetermined adjustment paper P.

As a result, it is possible to perform printing by the print head 41 and printing of the correction pattern M for acquiring an alignment value using paper having paper quality suitable for image recognition of a subsequent paper image.

Therefore, the more precise alignment value can be acquired.

In the present embodiment, the second color printed by the second head is the same as or similar to the surface color of the print target surface.

For example, in a case of drawing various designs on the print target surface, various color inks are used, and the correction pattern M for correcting the print head 41 (design head 41*b*) that prints the relevant color is also printed with a color ink. Therefore, as the adjustment paper P in this case, the white adjustment paper P on which the correction pattern M printed with the color ink can be easily identified is suitably used.

On the other hand, in a case where the print head 41 (undercoating head 41*a*) that prints the undercoating or the like with, for example, a white ink is present among the plurality of print heads 41, it is difficult to recognize a position where the correction pattern M has been printed if the correction pattern M is printed as it is since the color to be printed is the same as or similar to the surface color of the adjustment paper P.

In this regard, the second head (undercoating head 41*a*) is caused to perform printing so as to overlap the first color area Ar1 formed by the first head (design head 41*b*) in the present embodiment, so that the correction pattern M printed by the second head (undercoating head 41*a*) can be identified even if the color of the adjustment paper P is white or the like.

As a result, it is possible to appropriately obtain the alignment values for the respective print heads 41 only by preparing one adjustment paper P even in a case where the undercoating head 41*a* that performs printing with white or the like is provided in addition to the design head 41*b* that performs color printing.

In addition, the plurality of print heads 41 include the design head 41*b* that prints the design and the undercoating head 41*a* that prints a part other than the design in the present embodiment.

As a result, it is possible to perform from the formation of the undercoating to the printing of the design using the single printing apparatus 1, user's time and effort for manually applying the undercoating can be saved. In addition, it is possible to suppress the occurrence of uneven coating, an uncoated portion, a protrusion, and the like as compared with the case of manually applying the undercoating.

In addition, the first correction pattern M1 as the correction pattern M for performing alignment correction of the first head, printed based on the alignment adjustment range, which is the range that can be handled by alignment correction out of the "amount of possible deviation" (the amount of deviation when the print position deviates to the maximum extent) by which the print position of each of the print heads 41 (the first head and the second head) is likely to deviate, is printed at a predetermined position on the print target surface with the first color distinguishable from the surface color of the print target surface by controlling the first head (for example, the design head 41*b*) in the present embodiment. Then, the second head (for example, the undercoating head 41*a*) is controlled such that at least a part of the second correction pattern M2 for performing alignment correction of the second head is printed so as to overlap the print range of the first correction pattern M1 with the second color distinguishable from the first color.

As a result, it is possible to avoid a situation in which the second correction pattern M2 is printed with white on a white background, and the print position of the second correction pattern M2 can be reliably detected from the paper image. Therefore, the alignment value can be reliably acquired, and the alignment of the print head 41 can be appropriately performed.

In addition, the print range of the first correction pattern M1 is the range having the length, equal to or longer than the sum of the alignment adjustment range $\alpha$ in the first head and the alignment adjustment range $\beta$ in the second head, as the radius $\gamma$ in the present embodiment.

As a result, even when the respective print heads 41 (first head and second head) deviate in the diametrically opposite directions, at least a part (a portion including the center point D2) of the second correction pattern M2 overlaps within the print range of the first correction pattern M1. Therefore, the center point D2 can be appropriately detected from the paper image, and the alignment value can be obtained.

Although the embodiment of the present invention has been described as above, the present invention is not limited to the embodiment, and it goes without saying that various modifications can be made within a scope not departing from a gist of the present invention.

For example, the case where the first color area Ar1 is the area where the first correction pattern M1 has been printed by the first head (for example, the design head 41*b* capable of printing the color distinguishable from white when the adjustment paper P is white) has been given as an example in the present embodiment. However, the first color area Ar1 may be any area formed by the first head (for example, the design head 41*b*), and is not limited to the area sphere the first correction pattern M1 has been printed.

For example, the first color area Ar1 may be a filling area formed by filling at least a part of the adjustment paper P (print target surface) with a first color. A range of the filling area is not particularly limited as long as a space for printing the second correction pattern M2 can be secured. For example, the entire surface of the adjustment paper P (print target surface) may be filled.

When the first color area Ar1 is set as the filling area in this manner, the first correction pattern M1 may be a figure or a mark that makes it difficult to secure a sufficient area as an area for printing the second correction pattern M2, such as a line and a point, and the degree of freedom is increased in the shape of the first correction pattern M1.

Although the filling area may be an area formed as an area for printing the second correction pattern M2 regardless of the first correction pattern M1, the filling area may be formed by performing reset printing for erasing the first correction pattern M1 by the first head (for example, the design head 41*b*). In this case, it is sufficient to fill the periphery of the already printed first correction pattern ML and thus, the amount of ink used for filling can be suppressed as much as possible.

Figure 9:
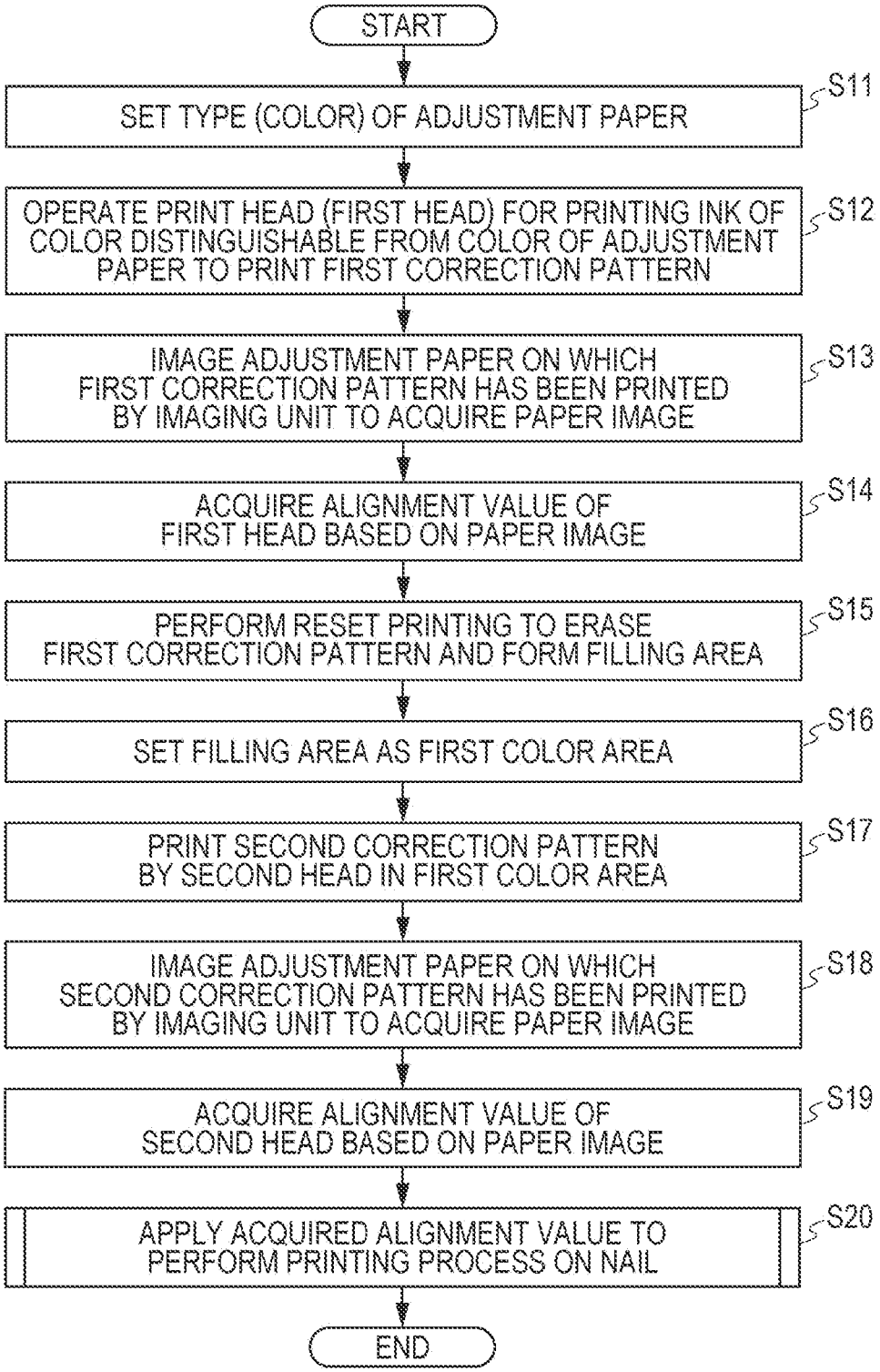
FIG. 9 is a flowchart illustrating a printing control process according to a modification of the present embodiment.

A procedure in a case of forming a first color area by performing the reset printing will be described with reference to FIGS. 9 and 10A to 10C. Note that Steps S11 to S14 in FIG. 9 are similar to Steps S1 to S4 in FIG. 5, and thus, will be briefly described.

Figure 10A:
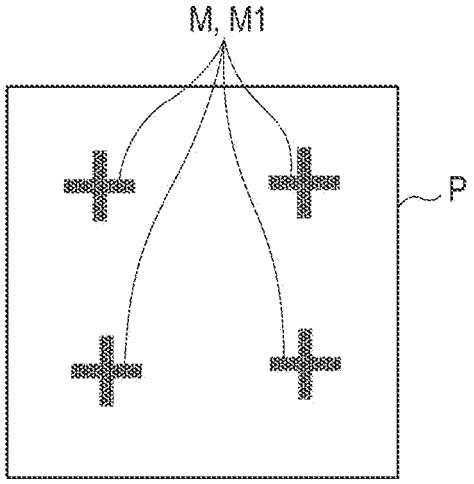
FIG. 10A is a plan view illustrating a state where a first correction pattern is printed on adjustment paper.

When a case where white paper is set as the adjustment paper P (Step S11) is described as an example, first, the first correction pattern M1 is printed with a first color (for example, black) by a first head (for example, the design head 41*b*) (see Step S12 and FIG. 10A), and the adjustment paper P is imaged to acquire a paper image (Step S13). Note that FIG. 10A illustrates a case where there are four cross-shaped first correction patterns M1, but the first correction pattern M1 may have any shape as long as an alignment value can be derived, and the specific shape is not limited to the illustrated example. Then, an alignment value for the first head (for example, the design head 41*b*) is acquired based on the paper image (Step S14).

Figure 10B:
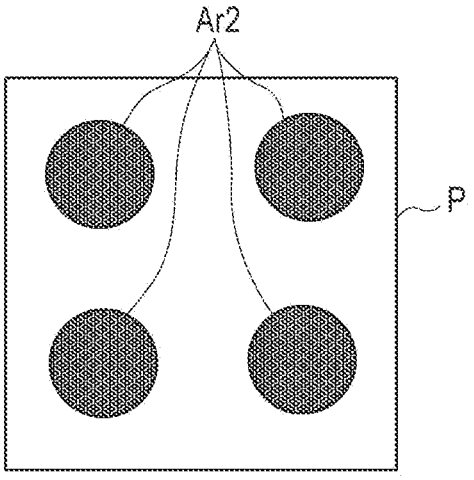
FIG. 10B is a plan view illustrating a state where reset printing for filling the first correction pattern is performed.

Next, reset printing for filling the first correction pattern M1 is performed by the first head (for example, the design head 41*b*), and a filling area filled with the first color is formed (see Step S15 and FIG. 10B). Although FIG. 10B illustrates an example in which the four cross-shaped first correction patterns M1 are filled into a circle, the shape of the filling area is not limited to the illustrated example.

Figure 10C:
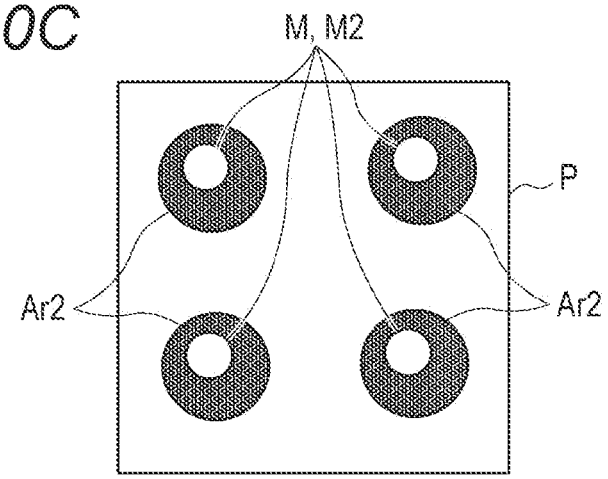
FIG. 10C is a plan view illustrating a state where a second correction pattern is printed using a filling area formed by the reset printing as a first color area.

Then, the filling area is set as a first color area Ar2 (Step S16), and the second correction pattern M2 is printed in the first color area Ar2 by a second head (for example, the undercoating head 41*a*) (see Step S17 and FIG. 10C).

Note that Steps S18 to S20 in FIG. 9 are similar to Steps S7 to S9 in FIG. 5, and thus, the description thereof will be omitted.

In addition, it suffices that the second correction pattern M2 is printed with a second color so as to at least partially overlap the first color area, and a part of the second correction pattern M2 may be printed on the adjustment paper P on which nothing is printed.

Figure 11A:
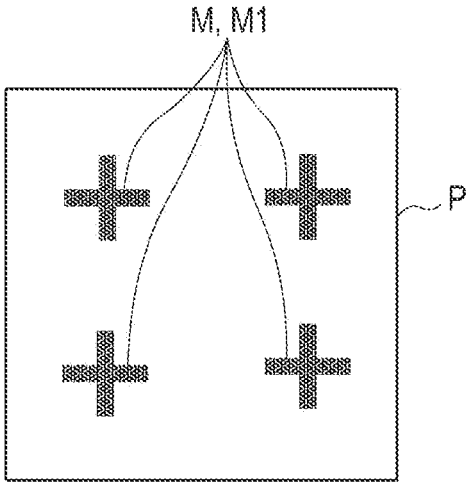
FIG. 11A is a plan view illustrating a state where a first correction pattern is printed on adjustment paper.
Figure 11B:
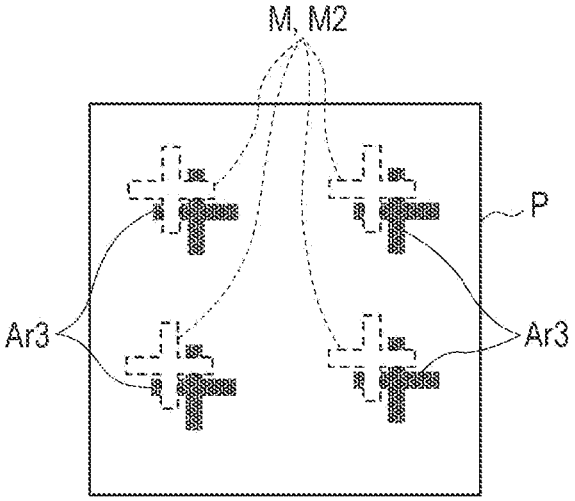
FIG. 11B is a plan view illustrating a state where a second correction pattern is printed so as to overlap a part of a first color area using an area where the first correction pattern has been printed as the first color area.

For example, as illustrated in FIG. 11A, the first head (for example, the design head 41*b*) prints the first correction pattern such as a black cross, on the white adjustment paper P, and then, the second head (for example, the undercoating head 41*a*) prints the second correction pattern M2 such as a white cross (indicated by a partially outlined broken line in FIG. 11B) so as to at least partially overlap an area where the black cross has been drawn which is a first color area Ar3.

Even in this case, it is sufficient that the correction pattern M can be recognized to such an extent that information required to obtain an alignment value for performing alignment correction (for example, coordinate information of a center of the cross as the correction pattern M) can be acquired.

In addition, the number of times of printing the correction pattern M on one adjustment paper P is not limited to once for each of the first correction pattern M1 and the second correction pattern M2.

For example, the second correction pattern M2 may be printed with a second color (color such as white) after printing the first correction pattern M1 with a first color (color such as black), and further, the first correction pattern M1 may be printed with the first color (color such as black) so as to at least partially overlap the second correction pattern M2 or the like.

The alignment correction is assumed to be performed at a timing when the print head 41 is replaced. The adjustment paper P is once removed together with the paper arrangement member 67 and printing is performed on the nail after printing is performed once for each of the first correction pattern M1 and the second correction pattern M2. Then, when the alignment correction is performed at the timing of replacing the print head 41 or the like, the same adjustment paper P may be arranged on the paper arrangement member 67 again and set in the apparatus to print the first correction pattern M1 and the second correction pattern M2.

In a case where the correction pattern M of the same color is printed on the same adjustment paper P a plurality of times, a shape of a figure or the like to be printed as the correction pattern M may be changed every time so as to be easily distinguished from the correction patterns M printed up to the previous time.

Note that the respective print heads 41 are not necessarily replaced at the same time due to ink runout or the like, and it is also conceivable that one of a first head (for example, the design head 41*b*) and a second head (for example, the undercoating head 41*a*) is continuously replaced and is set as a target of alignment correction. For example, there may be a case where alignment correction is required only for the undercoating head 41*a* and the second correction pattern M2 is printed by the undercoating head 41*a* continuously twice when only an ink of the undercoating head 41*a* is used up and replaced after the first correction pattern M1 is printed by the design head 41*b*, the second correction pattern M2 is printed by undercoating head 41*a*, and the alignment correction is performed for each of the print heads 41.

In this case, when there is no sufficient space for printing the second correction pattern M2 in a first color area formed by a first head (for example, the design head 41*b*), the first head (for example, the design head 41*b*) may form a filling area, and the second correction pattern M2 may be printed using the filling area as a new first color area.

Although the print target surface is the surface of the adjustment paper P in the present embodiment, for example, the print target surface may be a surface of a nail.

In this case, for example, the first correction pattern M1 may be printed on the nail surface with white or the like using the undercoating head 41*a* as a first head, and the second correction pattern M2 may be printed by the design head 41*b* as a second head with an area where the first correction pattern M has been printed as the first color area Ar1.

In this case, an undercoating is once applied to the entire nail surface by the undercoating head 41*a* before the main printing for printing a nail design, and the nail design is printed by the design head 41*b* after painting the second correction pattern M2 printed by the design head 41*b*.

In this manner, in a case where the first correction pattern M1 and the second correction pattern M2 are printed using the nail surface as the print target surface to perform alignment correction, it is unnecessary to separately prepare the adjustment paper P, and the alignment correction can be performed more easily.

In addition, the print head 41 of an inkjet system is provided as the print head 41 (the undercoating head 41*a* and the design head 41*b*) of the printing apparatus 1 in the present embodiment, but the configuration of the print head 41 is not limited thereto.

Both or any one of the undercoating head 41*a* and the design head 41*b* may have a configuration other than the inkjet system, for example, a pen-plotter system.

In addition, the case where the print heads 41 (the undercoating head 41*a* and the design head 41*b*) are mounted on one carriage 42 and moved by the same head movement mechanism 49 has been given as an example in the present embodiment, but the configuration of the print head 41 is not limited thereto. For example, the undercoating head 41*a* and the design head 41*b* may be configured to perform the printing operation while separately moving.

In addition, the case where the printing apparatus 1 and the terminal device 7 cooperate to perform printing has been given as an example in the present embodiment, but all the operations may be completed only by the printing apparatus 1.

In this case, the printing apparatus 1 may be provided with a display unit capable of confirming an image and a design of the nail T.

In addition, for example, a design storage area or the like configured to store nail designs may be provided in the storage unit 32 of the printing apparatus 1, and the designs stored here may be proposed to a user to allow the user to select any design.

When the printing apparatus 1 can be connected to various networks, it may be configured such that a nail design (design), stored in a server device illustrated) or the like connectable to the network, can be acquired. In a case where the externally acquired design can be proposed to the user as a candidate for the selectable nail design in this manner, a wide variety of nail designs can be printed on the nail T.

Although the case where the control unit 81 on the terminal device 7 side performs processing such as the detection of the nail information, the acquisition of the alignment value, and the generation of the print data has been described in the present embodiment, it is not essential to perform all these processes on the terminal device side. Some or all of these processes may be performed by the control unit 31 of the printing apparatus 1.

In a case where various processes are shared between the printing apparatus 1 side and the terminal device 7 side as described above, loads on the control devices 30 and 80 (loads in terms of the processing capabilities of the control units 31 and 81 and loads in terms of memory capacities of the storage units 32 and 82) are also distributed, and the load on each unit can be reduced.

Although some embodiments of the present invention have been described above, a scope of the present invention is not limited to the above-described embodiments, and includes a scope of inventions described in the claims and a scope of the equivalents thereof.

What is claimed is:

1. A printing apparatus comprising:

a plurality of heads including at least a first head and a second head for alignment correction configured to print mutually different colors on a print target surface; and at least one processor configured to control the heads, wherein the processor is configured to:

operate the first head, configured to print a first color distinguishable from a surface color of the print target surface, to print a first correction pattern on the print target surface; and operate the second head, configured to print a second color distinguishable from the first color, to print a second correction pattern on the print target surface so as to at least partially overlap a first color area which is an area formed by printing of the first head.

2. The printing apparatus according to claim 1, wherein the first head prints the first color area which is a filling area formed by filling at least a part of the print target surface with the first color.

3. The printing apparatus according to claim 2, wherein the first head prints the filling area formed by performing reset printing for erasing the first correction pattern.

4. The printing apparatus according to claim 1, wherein the processor is configured to:

control the first head to print the first correction pattern, printed based on alignment adjustment ranges of the first head and the second head, at a position on the print target surface with the first color, which is distinguishable from the surface color of the print target surface; and control the second head to print at least a part of the second correction pattern using the second color distinguishable from the first color so as to overlap a print range of the first correction pattern.

5. The printing apparatus according to claim 4, wherein the print range of the first correction pattern is a range having a radius equal to or longer than a total length of the alignment adjustment range of the first head and the alignment adjustment range of the second head.

6. The printing apparatus according to claim 1, wherein the print target surface when the first correction pattern and the second correction pattern are printed is a surface of adjustment paper.

7. The printing apparatus according to claim 1, wherein the second head performs printing using the second color that is equal or similar to the surface color of the print target surface.

8. The printing apparatus according to claim 1, wherein the plurality of heads include a design head that prints a design and an undercoating head that prints a part other than the design.

9. The printing apparatus according to claim 8, wherein the first head is the undercoating head, the second head is the design head, and the print target surface is a surface of a nail.

10. A printing control method, performed by at least one processor, for a printing apparatus which includes a plurality of heads including at least a first head and a second head for alignment correction configured to print mutually different colors on a print target surface, the printing control method comprising:

operating the first head, configured to print a first color distinguishable from a surface color of the print target surface, to print a first correction pattern on the print target surface; and operating the second head, configured to print a second color distinguishable from the first color, to print a second correction pattern such that at least a part of the second correction pattern overlaps a first color area which is an area formed by printing of the first head on the print target surface.

11. The printing control method according to claim 10, wherein the first head prints the first color area which is a filling area formed by filling at least a part of the print target surface with the first color.

12. The printing control method according to claim 11, wherein the first head prints the filling area formed by performing reset printing for erasing the first correction pattern.

13. The printing control method according to claim 10, further comprising:

controlling the first head to print the first correction pattern, printed based on alignment adjustment ranges of the first head and the second head, at a position on the print target surface with the first color, which is distinguishable from the surface color of the print target surface; and controlling the second head to print at least a part of the second correction pattern using the second color distinguishable from the first color so as to overlap a print range of the first correction pattern.

14. The printing control method according to claim 13, wherein the print range of the first correction pattern is a range having a radius equal to or longer than a total length of the alignment adjustment range of the first head and the alignment adjustment range of the second head.

15. The printing control method according to claim 10, wherein the print target surface when the first correction pattern and the second correction pattern are printed is a surface of adjustment paper.

16. The printing control method according to claim 10, wherein the second head performs printing using the second color that is equal or similar to the surface color of the print target surface.

17. The printing control method according to claim 10, wherein the plurality of heads include a design head that prints a design and an undercoating head that prints a part other than the design.

18. The printing control method according to claim 17, wherein the first head is the undercoating head, the second head is the design head, and the print target surface is a surface of a nail.

19. A non-transitory computer-readable recording medium a program stored thereon, which, when executed on at least one processor a computer of a printing apparatus which includes a plurality of heads including at least a first head and a second head for alignment correction configured to print mutually different colors on print target surface, causes the computer to:

operate the first head, configured to print a first color distinguishable from a surface color of the print target surface, to print a first correction pattern on the print target surface; and operate the second head, configured to print a second color distinguishable from the first color, to print a second correction pattern such that at least a part of the second correction pattern overlaps a first color area which is an area formed by the first head on the print target surface.

* * * * *